US005408396A

United States Patent [19]

Stanley

[11] Patent Number: 5,408,396

[45] Date of Patent: Apr. 18, 1995

[54] ILLUMINATED EARRING HOLDER

[75] Inventor: Clint C. Stanley, Balboa Island, Calif.

[73] Assignee: CCS International Corp., Balboa Island, Calif.

[21] Appl. No.: 237,681

[22] Filed: May 4, 1994

[51] Int. Cl.[6] ..... F21Y 33/00

[52] U.S. Cl. ..... 362/253; 362/104; 362/357

[58] Field of Search ..... 362/253, 351, 355, 356, 362/357, 358, 410, 414, 806, 104; D26/128, 125, 130, 135, 136

[56] References Cited

U.S. PATENT DOCUMENTS

| | | | |
|---|---|---|---|
| 130,899 | 8/1872 | Combs | D26/135 |
| 310,953 | 1/1885 | Mersereal | D26/129 |
| 1,745,365 | 2/1930 | Feiler | 362/806 |
| 1,863,767 | 6/1932 | Shapiro | 362/358 |
| 1,910,941 | 5/1933 | Ufert | 362/410 |
| 1,914,480 | 6/1933 | Brosilow et al. | 362/410 |
| 1,919,838 | 7/1933 | Hadly | 362/410 |
| 2,067,018 | 1/1937 | Pretzfelder | 362/806 |
| 2,122,971 | 7/1938 | Angeletti | 362/358 |

FOREIGN PATENT DOCUMENTS

| | | | |
|---|---|---|---|
| 1074410 | 4/1953 | France | 362/356 |

OTHER PUBLICATIONS

Tripp et al, "Patern Portfolio—Designs for the Discriminating Lampshade Artist", 1984.

*Primary Examiner*—Richard R. Cole
*Attorney, Agent, or Firm*—Klein & Szekeres

[57] ABSTRACT

An illuminated earring holder comprises an electric lamp with a rotatable lamp shade, wherein the shade is provided with a multiplicity of holes, each of which is dimensioned to receive the post of a straight post earring, or the hook of a hook-type earring. In a preferred embodiment, some of the holes are provided near the bottom edge of the shade, and a filament of thread, wire, or monofilament material is threaded through the holes near the bottom edge. Earrings, particularly hoop-type earrings, can be suspended from the filament. In the preferred embodiment, the lamp also includes a dish-like base with an upturned peripheral lip, for holding the earring backs.

19 Claims, 1 Drawing Sheet

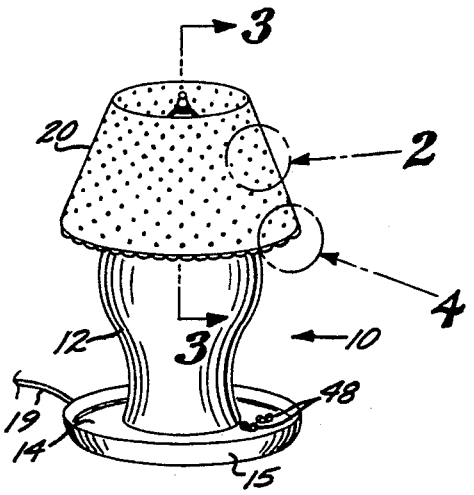
FIG. 1
FIG. 2
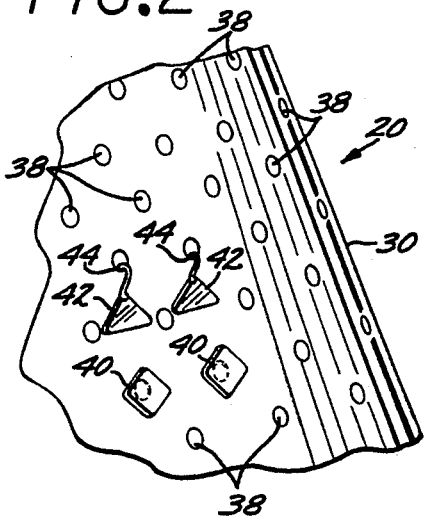
FIG. 3
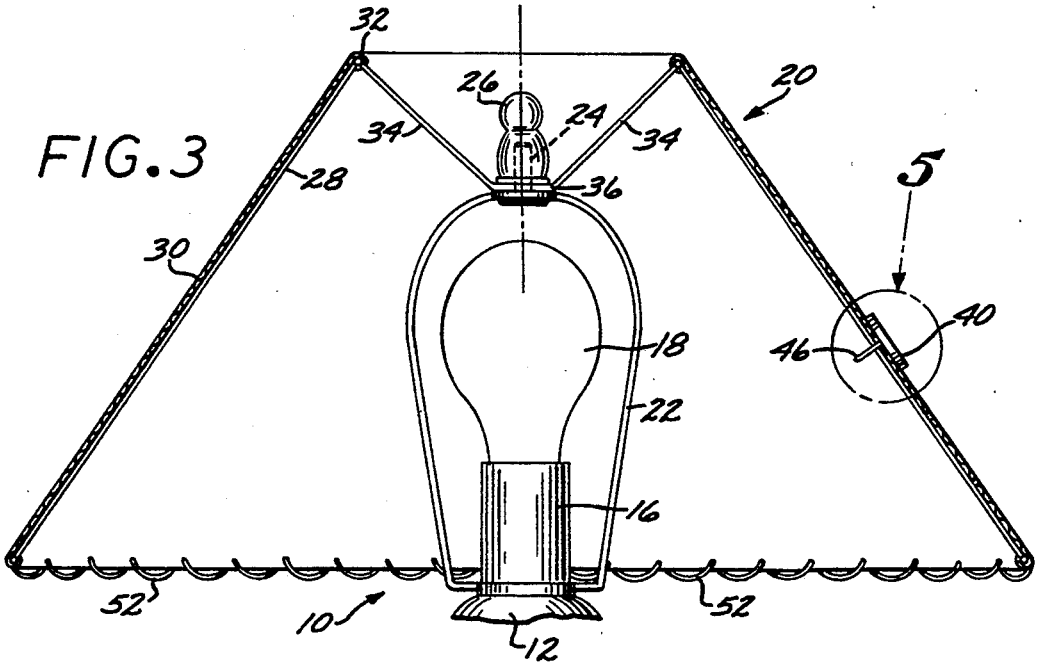
FIG. 4
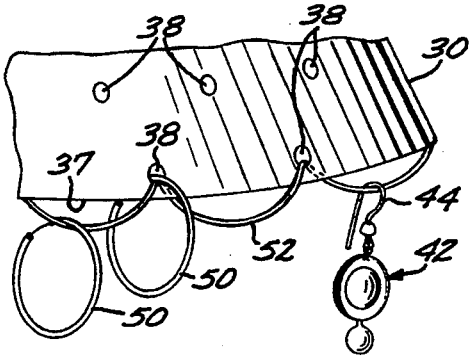
FIG. 5
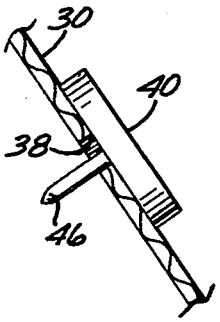

ILLUMINATED EARRING HOLDER

BACKGROUND OF THE INVENTION

This invention relates generally to the field of illumination devices, and more particularly to the field of electric lamps. More specifically, the present invention relates to a lamp that serves as a holder for the storage of earrings, thereby becoming, in effect, an illuminated earring holder.

Earrings are typically small objects, sometimes of great monetary and/or sentimental value. Storage of earrings, so as not to misplace them, is important to their owners. Jewelry boxes are most commonly used for this purpose, although other types of receptacles and holders have been devised. On the other hand, storage of the earrings in a manner that allows their display may be preferred. To date, however, little attention has been paid to devices for holding earrings for display in the home.

SUMMARY OF THE INVENTION

Broadly, the present invention is an illuminated earring holder, comprising an electric lamp and a lamp shade mounted on the lamp, wherein the shade is provided with a multiplicity of holes, each of the holes being dimensioned to receive the post of an earring.

In a specific preferred embodiment, the lamp (other than the shade) is a conventional table lamp, comprising a vertical pedestal portion attached at its bottom to an annular, dish-like base. An internally-threaded electric socket for a standard light bulb is attached to the top of the pedestal, the pedestal and the base being internally channeled, in the conventional manner, for the passage of an AC power cord from the socket. An earring-holding shade is affixed to the pedestal in the usual manner, i.e., by means of a threaded fitting on the top of a metal hoop attached to the top of the pedestal and encircling the bulb.

The shade is provide with a multiplicity of holes, either randomly distributed or in any desired pattern. Each of the holes is dimensioned to receive and hold the post of an earring. A plurality of holes near the bottom edge of the shade accommodate hoop-type earrings, or earrings with hook-shaped posts. Alternatively, a filament of thread, cord, or wire may be threaded through the bottom edge holes, from which filament hoop-type earrings, or those with hook-shaped posts, may be suspended. Bracelets and necklaces may likewise be hung from the filament.

The dish-like base of the lamp provides a convenient place for the storage of the backing elements of the earrings.

The present invention thus provides means for conveniently storing and displaying earrings in a decorative manner. Viewed in another way, the present invention provides a novel decorative lamp that creates an aesthetically-pleasing display, especially when lit, when the shade is holding a multiplicity of earrings.

BRIEF DESCRIPTION OF THE DRAWINGS

FIG. 1 is a perspective view of a lamp incorporating the present invention;

FIG. 2 is an enlarged detailed view of the portion of the lamp shade enclosed within the broken circle 2 in FIG. 1;

FIG. 3 is a cross-sectional view taken along line 3—3 of FIG. 1;

FIG. 4 is an enlarged detailed view of the portion of the lamp shade enclosed within the broken circle 4 in FIG. 1; and FIG. 5 is an enlarged detailed view of the portion of the lamp shade enclosed within the broken circle 5 in FIG. 3.

DETAILED DESCRIPTION OF THE INVENTION

Referring first to FIGS. 1 and 3 a table lamp 10 incorporating the present invention is shown. The lamp 10 comprises a vertical pedestal 12 attached at its bottom to an annular, dish-like base 14 with an upturned peripheral lip 15. The pedestal 12 shown in the drawing is exemplary only; any aesthetically-pleasing shape for the pedestal may be employed. The pedestal 12 and the base 14 are preferably made as an integral unit.

An internally-threaded electrical socket 16, accommodating a standard light bulb 18, is attached to the top of the pedestal 12 in the usual manner. The pedestal 12 and the base 14 are internally channeled (not shown) in the conventional manner for an AC power cord 19 that runs from the interior of the socket 16 to a conventional plug (not shown).

A lamp shade 20, constructed in accordance with the present invention, is attached to the pedestal 12 in a conventional manner. Exemplary attachment means, briefly summarized, comprise an inverted U-shaped bracket or hoop 22 that is fixed at its lower ends to the top of the pedestal 12, the hoop 22 thereby encircling the bulb 18. Fixed to the top of the hoop 22 is an externally-threaded fitting 24, which receives an internally-threaded finial 26.

The shade 20 comprises a wire frame 28 supporting a plastic or fabric covering 30. The frame 28 includes an annular top portion 32 defining a top edge of the shade. A plurality of spokes 34 extend radially inwardly and downwardly from the top portion 32 of the frame 28. The radially inner ends of the spokes 34 are fixed to a mounting ring 36 that is dimensioned to seat on the externally-threaded fitting 24. The mounting ring 36 is loosely secured to the fitting 24 by the finial 26, thereby allowing the shade 20 to be rotated around the fitting 24.

The shade has a bottom edge 37, which may be defined by an annular bottom portion of the frame 28. The bottom edge 37 has a perimeter (or circumference, if the edge is annular) that is greater than the perimeter (or circumference) of the top edge. The shade covering 30 defines a shade surface extending between the top and bottom edges.

The shade covering 30 is provided with a plurality of holes 38, which may either be randomly distributed throughout the covering 30, or which may be distributed in a regular, repetitive pattern, as shown in FIG. 2. Alternatively, the holes 38 may be formed in a decorative configuration, such as an abstract design or the silhouette of an object.

As shown in FIGS. 2 and 3, straight post earrings 40 and hook-type earrings 42 can be removably retained in the holes 38. Specifically, each of the holes 38 is dimensioned to hold either a hook 44 of the hook-type earring 42, or a post 46 of a straight post earring 40. The holes 38 should not be much larger in diameter than the typical earring post 46, as shown in FIG. 5. For best retention of the earrings, a shade 20 having about a 12/12 pitch is preferred.

The straight post earrings 40 typically have removable retaining members or backs 48, which may be placed in the dish-like base 14 of the lamp, as shown in FIG. 1, when the earrings are held in the shade 20.

Whatever pattern of holes 38 is employed, it is advantageous to have a bottom row of holes 38 near the bottom edge 37 of the shade 20, as best shown in FIG. 4. A hole 38 situated near the bottom edge 37 can accommodate a hoop-type earring 50. Alternatively, a filament 52 may be threaded through the holes 38 near the bottom edge of the shade. The filament 52, which may be a fabric thread, a wire, or a synthetic monofilament (e.g., nylon), is used to suspend either hoop-type earrings 50 or hook-type earrings 42. The filament 52 may also be used to suspend small bracelets (not shown).

When earrings are held in the lamp shade 20, as described above, they create an aesthetically pleasing display that is especially enhanced when the lamp is illuminated. It is advantageous to use a white or light-colored, translucent material for the shade covering 30, so that the lamp provides good room illumination while also providing a back-lit or illuminated high-lighting effect for the earrings held in the shade 20. A dark shade may also provide a pleasing visual effect in conjunction with earrings having translucent gems or glass. In any case, the earrings are conveniently stored between wearings in a manner that creates a pleasing visual display, unique to each individual, that may be changed as easily as rearranging or changing the earrings in the shade. Moreover, the invention allows the display of the owner's collection of earrings (and other jewelry) with easy access and selectability, while providing a convenient way of keeping earring pairs together to minimize loss.

Although a preferred embodiment of the invention has been described herein, various modifications may suggest themselves to those skilled in the pertinent arts. For example, although the shade 20 shown and described herein is in the form of a truncated right frusticone, it may also be formed as a truncated pyramid with any number of sides. The attachment means for attaching the shade to the lamp may be of any conventional design, preferably one that allows for rotation of the shade relative to the lamp pedestal. The invention may also be easily adapted for a floor lamp, the invention being considered, in its broadest aspect, an improvement in the shade structure alone, without regard to the lamp to which it may be attached. These and other modifications that may suggest themselves should be considered within the spirit and scope of the invention, as defined in the claims that follow.

What is claimed is:

1. An illuminated display device, comprising:

a plurality of earrings, each having a post or a hook;

a lamp having a vertical pedestal having an upper portion and a lower portion;

a shade attached to the upper portion of the pedestal; and a plurality of holes formed in the shade, at least some of the holes each receiving the post or hook of one of the earrings.

2. The device of claim 1, wherein the lower portion of the pedestal is fixed to a base having an upturned peripheral lip.

3. The device of claim 1, further comprising means for rotatably attaching the shade to the pedestal.

4. The device of claim 1, wherein the shade has a bottom edge, and wherein some of the plurality of holes are adjacent to the bottom edge.

5. The device of claim 4, further comprising filament means, threaded through the holes adajcent to the bottom edge, for suspending a second plurality of earrings therefrom.

6. The device of claim 1, wherein the shade has a top edge defining a first perimeter or circumference, and a bottom edge defining a second perimeter or circumference greater than the first perimeter or circumference.

7. The device of claim 6, wherein the holes are formed in a shade surface between the top edge and the bottom edge.

8. The device of claim 7, wherein the shade is a truncated right frusticone.

9. An illuminated display device, comprising:

a lamp including a vertical pedestal having an upper portion and a lower portion;

plurality of earrings, each having a post or a hook a lamp shade attached to the upper portion of the pedestal and having a top edge with a first perimeter or circumference and a bottom edge with a second perimeter or circumference greater than the first perimeter or circumference;

a shade surface defined between the top edge and the bottom edge and defining an angle of not more than about 60 degrees from the horizontal; and a plurality of holes in the shade surface, at least some of the holes each receiving the post or hook of one of the earrings.

10. The device of claim 9, wherein at least some of the holes are located adjacent to the bottom edge of the shade.

11. The device of claim 10, further comprising filament means, threaded through the holes adjacent to the bottom edge of the shade, for suspending a second plurality of earrings therefrom.

12. The device of claim 9, further comprising attachment means for rotatably attaching the shade to a lamp.

13. The device of claim 12, wherein the attachment means comprises:

a frame element defining the top shade edge;

a plurality of spokes descending downwardly and radially inwardly from the frame element, each of the spokes terminating in an inner end; and a mounting ring attached to the inner ends of the spokes.

14. The device of claim 9, wherein the shade is a truncated right frusticone.

15. An illuminated display device, comprising:

a plurality of earrings, each having a post or a hook;

a lamp having a vertical pedestal having an upper portion and a lower portion, the lower portion being fixed to a base;

an upturned lip around the periphery of the base;

a shade rotatably attached to the upper portion of the pedestal; and a plurality of holes formed in the shade, at least some of the holes each receiving the post or hook of one of the earrings.

16. The device of claim 15, wherein the shade has a bottom edge, and wherein at least some of the plurality of holes are located adjacent to the bottom edge, and wherein the device further comprises filament means, threaded through the holes adjacent to the bottom edge, for suspending a second plurality of earrings therefrom.

17. The device of claim 15, wherein the shade includes a top edge having a first perimeter or circumference and a bottom edge having a second perimeter or circumference greater than the first perimeter or circumference.

18. The device of claim 17, wherein the holes are formed in a shade surface between the top edge and the bottom edge.

19. The device of claim 18, wherein the shade is a truncated right frusticone.

* * * * *